United States Patent [19]

Yonezawa

[11] Patent Number: 5,065,610

[45] Date of Patent: Nov. 19, 1991

[54] CLAMPING APPARATUS FOR PRESS BRAKE

[75] Inventor: Keitaro Yonezawa, Kobe, Japan

[73] Assignee: Kabushiki Kaisha Kosmek, Kobe, Japan

[21] Appl. No.: 661,138

[22] Filed: Feb. 27, 1991

[30] Foreign Application Priority Data

Mar. 12, 1990 [JP] Japan ..... 2-62159

[51] Int. Cl.[5] ..... B21D 37/04

[52] U.S. Cl. ..... 72/462; 72/481

[58] Field of Search ..... 72/462, 481, 389

[56] References Cited

U.S. PATENT DOCUMENTS

| | | | |
|---|---|---|---|
| 4,506,538 | 3/1985 | Jones, Jr. | 72/462 |
| 4,787,237 | 11/1988 | Houston et al. | 72/462 |
| 4,895,014 | 1/1990 | Houston | 72/462 |

FOREIGN PATENT DOCUMENTS

| | | | |
|---|---|---|---|
| 256245 | 2/1988 | European Pat. Off. | 72/481 |
| 3932629 | 4/1990 | Fed. Rep. of Germany | 72/481 |
| 64-49318 | 3/1989 | Japan . | |

*Primary Examiner*—David Jones

*Attorney, Agent, or Firm*—Bacon & Thomas

[57] ABSTRACT

An upper portion (3*a*) of an upper-die (3) is fixedly secured to a lower portion (2) of a ram (1) extending horizontally by way of a first clamping member (5) and a second clamping member (6) therebetween from both the fore side and the back side. The second clamping means (6) comprises a plurality of press plates (8)(8) arranged side by side in the horizontal direction. An opperating oil chamber (20) of a hydraulic cylinder (19) provided in each press plate (8) is connected in communication to a pressurized oil outlet port (42) and to a pressurized oil inlet port (41) both of which are opened in laterally opposed end surfaces (8*b*)(8*a*) of the press plate (8) respectively. The pressurized oil outlet port (42) and the pressurized oil inlet port (41) facing each other of the adjacent press plates (8)( 8) are connected in communication to each other by means of an interconnection pipe (23).

6 Claims, 7 Drawing Sheets

CLAMPING APPARATUS FOR PRESS BRAKE

BACKGROUND OF THE INVENTION

1. Field of the Invention

The present invention relates to a clamping apparatus for a press brake, adapted to perform the fixing or the fixing cancellation of an upper-die relative to a ram of the press brake by means of a hydraulic operation in the press brake employed for a bending process and the like of a long-sized plate.

2. Prior Art

Hydraulically operated upper-die clamping apparatuses are known in the art as disclosed in Japanese Utility Model Laid Open Publication No. 1989-49318.

This apparatus comprises a clamping receiving member disposed on the back side of a ram lower portion, a clamping press member composed of a plurality of clamping press plates arranged side by side in the left and right direction on the front side of the ram lower portion and a clamping hydraulic cylinder internally disposed in each of the press plates. The upper-die to be butted to the ram lower portion from below is adapted to be fixedly secured between the clamping receiving member and the press plates by means of hydraulic forces of the respective hydraulic cylinders.

Pressurized oil supply/discharge ports connected in communication to an operating oil chamber of the hydraulic cylinder are opened in the upper surface of each press plate. The adjacent pressurized oil supply/discharge ports are interconnected to each other in sequence by means of a reversed U-shaped hydraulic pipe running along the space in front of the ram.

In the above-mentioned prior art, since the hydraulic pipes are arranged in such a manner so as to project into the space in front of the ram, a working space for bending a long-sized work plate becomes narrowed by that projecting distance. Further, in such prior art, it is possible that the hydraulic pipes could be broken and damaged by the bent work plate.

SUMMARY OF THE INVENTION

It is an object of the present invention to enlarge a working space for processing a work plate.

It is another object of the present invention to prevent breakage and damage of a hydraulic pipe.

For accomplishing the above-mentioned objects, the present invention is intended to improve the aforementioned upper-die clamping apparatus as follows.

A pressurized oil inlet port is opened in the first lateral end surface of each press plate, and a pressurized oil outlet port is opened in the second lateral end surface of the press plate. These pressurized oil inlet port and pressurized oil outlet port are connected in communication to the operating oil chamber of the hydraulic cylinder respectively. The pressurized oil inlet port and the pressurized oil outlet port facing each other in the adjacent press plates are connected in communication to each other by means of an interconnection pipe.

Incidentally, the hydraulic cylinder may be used as an unclamping actuation means or as an clamping actuation means, further also as an unclamping and clamping actuation means of the double-actuating type.

The clamping receiving member may be formed by arranging a plurality of receiving plates side by side or formed integrally as one piece. Further, the clamping receiving member may be formed separately from the ram or formed integrally with the ram.

Since the present invention is constructed as mentioned above, the following advantages can be provided.

Since the interconnection pipe is adapted to be mounted within the space between the adjacent press plates, it can be prevented from projecting into the space in front of the ram or into the space behind the ram contrary to the prior art. Therefore, it becomes possible to enlarge the working space for use in bending of the long-sized work plate.

Further, since the interconnection pipe can be mounted in the space inside the front surface or the rear surface of the press plate, it can be prevented from being broken and damaged by the bent work plate.

BRIEF DESCRIPTION OF THE DRAWINGS

The above and other objects, advantages and features of the present invention will be become apparent when considered with the following description and accompanying drawings wherein:

FIG. 1 is a front elevational view of an upper-die clamping apparatus;

FIG. 2 is a sectional view taken along the II—II directed line in FIG. 1;

FIG. 3 is a sectional view taken along the III—III directed line in FIG. 1;

FIG. 4 is a sectional view taken along the IV—IV directed line in FIG. 1;

FIG. 5 is an enlarged vertical sectional view of the portion indicated by the arrow A in FIG. 1, illustrating a fitted condition of an interconnection pipe;

FIG. 6 is an enlarged vertical sectional view thereof illustrating a fitting cancelled condition of the interconnection pipe;

FIG. 7 is a view corresponding to FIG. 3;

FIG. 8 is a view corresponding to FIG. 5;

FIG. 9 is a vertical sectional view of an air removal valve;

FIG. 10 is an enlarged view of the portion indicated by the arrow B in FIG. 8;

FIG. 11 is a partial view corresponding to FIG. 10, illustrating a variant thereof.

DESCRIPTION OF THE PREFERRED EMBODIMENTS

Embodiments of the present invention will be explained with reference to the accompanying drawings hereinafter.

FIGS. 1 through 6 illustrate a first embodiment.

Figure 1:
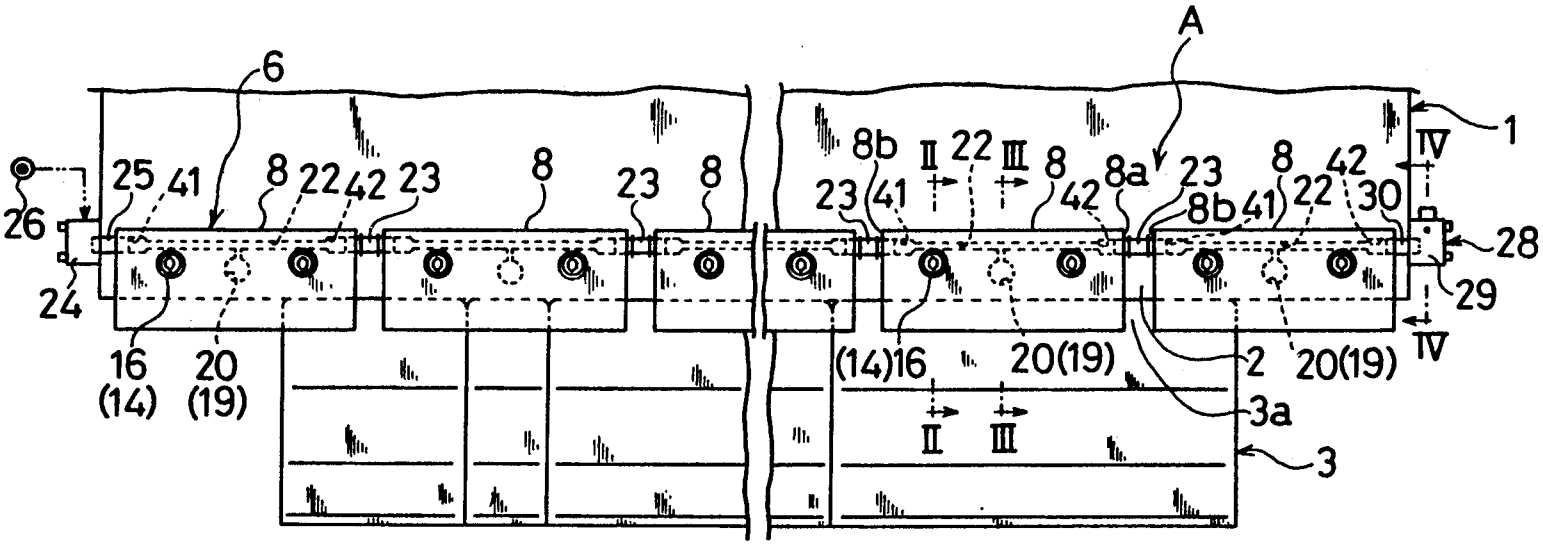
FIGS. 1 through 6 illustrate a first embodiment of the present invention.
Figure 2:
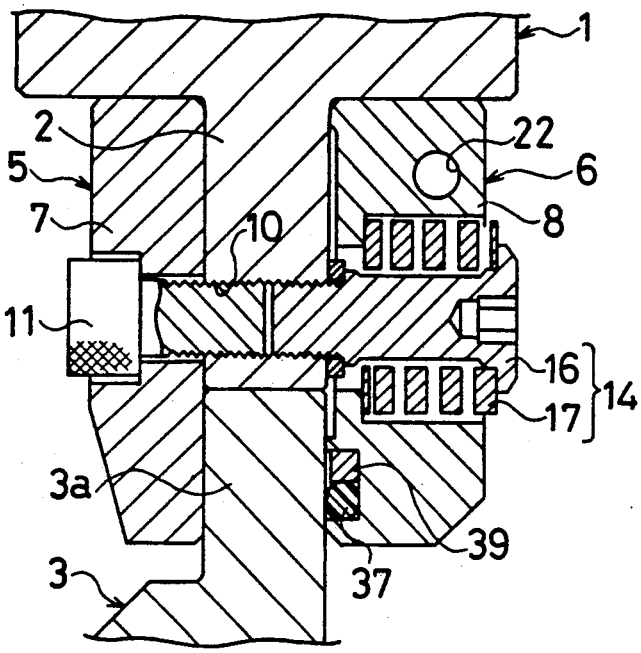
Figure 3:
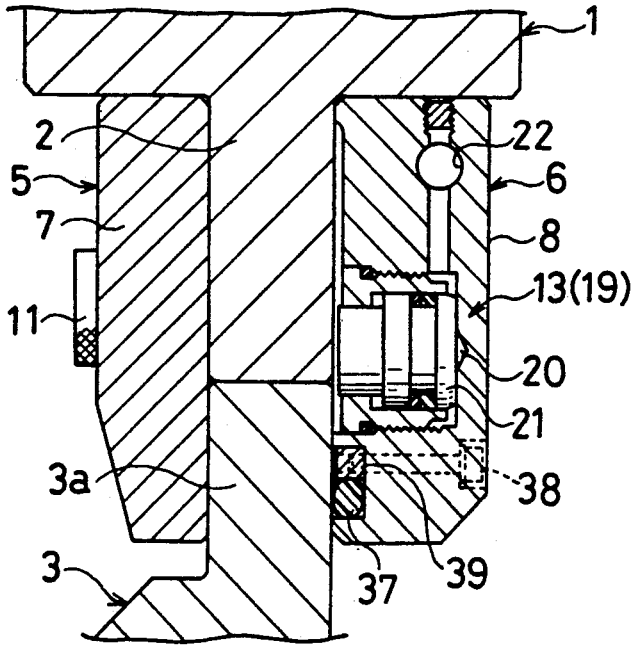

As illustrated in FIGS. 1 through 3, an upper portion 3*a* of an upper-die 3 is butted to a lower portion 2 of a ram 1 of a press brake from below. The upper portion 3*a* of the upper-die 3 is fixedly secured to the ram lower portion 2 by means of a clamping receiving member 5 as a first clamping member and a clamping press member 6 as a second clamping member therebetween from both the fore side and the back side. The clamping receiving member 5 is arranged on the back side (on the left side in FIGS. 2 and 3, similarly hereinafter), and the clamping press member 6 is arranged on the fore side (on the right side in the same figures, similarly hereinafter). The upper-die 3 is adapted to be suitably varied in overall length in the left and right direction by selecting the number of dies having different left and right directional dimensions and assembling them.

The clamping receiving member 5 comprises a plurality of receiving plates 7 arranged side by side in the left and right direction, and the clamping press member 6 comprises a plurality of press plates 8 arranged similarly.

As illustrated in FIG. 2, each receiving plate 7 is fixedly secured to the ram lower portion 2 by means of fixing bolts 11 threadably engaged with screw through-holes 10 formed in the lower portion 2.

Each press plate 8 is provided with an unclamping actuation means 13 and a clamping actuation means 14.

As illustrated in FIG. 2, the clamping actuation means 14 is adapted to actuate the press plate 8 toward the receiving plate 7 by means of clamping springs 17 held by spring retaining bolts 16 threadably secured to the screw through-holes 10.

As illustrated in FIG. 3, the unclamping actuation means 13 comprises a hydraulic cylinder 19. That is, an unclamping piston 21 is oil-tightly inserted into each operating oil chamber 20 formed in each press plate 8, so as to be slidable in the fore and back direction. Each press plate 8 is provided at its laterally opposed ends with a pressurized oil inlet port 41 and a pressurized oil outlet port 42 respectively, which are connected in communication to the operating oil chamber 20 through a communication passage 22 respectively. As illustrated in FIG. 1, the respective operating oil chambers 20, 20 of the adjacent press plates 8, 8 are connected in communication to each other by means of an interconnection pipe 23.

Further, as illustrated in FIG. 1, a hydraulic pump 26 is connected in communication to the pressurized oil inlet port 41 of the press plate 8 on the upstream-most side (the leftmost side) through both an end pipe 25 and a pressurized oil supply/discharge fitting 24 in order, and a valve box 29 of an air removal valve 28 is connected in communication to the pressurized oil outlet port 42 of the press plate 8 on the downstream-most side (the rightmost side) through an end pipe 30.

Figure 4:
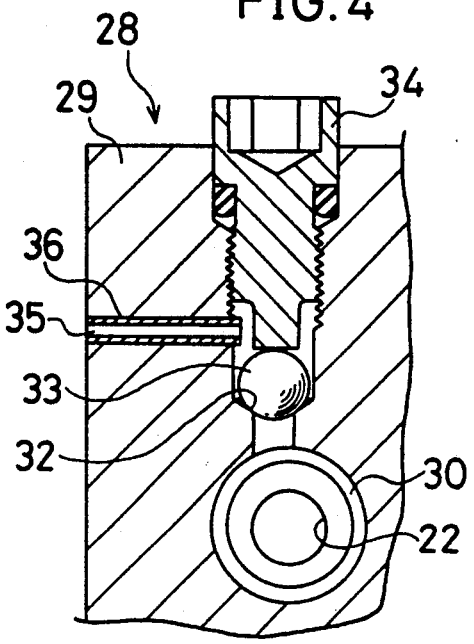

As illustrated in FIG. 4, the air removal valve 28 is constructed by bringing a ball valve member 33 into contact with an air removal valve seat 32 for valve closing by means of a valve closing member 34. A spring pin 36 passed through an air removal port 35 serves to prevent the ball valve member 33 from being pushed out.

Then, at the time of unclamping of the upper-die 3, by supplying the pressurized oil from the hydraulic pump 26 to the operating oil chamber 20 within each press plate 8, a hydraulic force exerted by the unclamping piston 21 surpasses a resilient force of the clamping spring 17 so that the press plate 8 can be actuated toward the direction going away from the clamping receiving member 5.

Incidentally, as illustrated in FIGS. 2 and 3, an urethane rubber gasket 37 is fitted in the lower portion of the backside of each press plate 8 in the laterally extending manner. This urethane rubber gasket 37 is so squeezed as to project backward (leftward in the figures) through a bolt 38 and a pushing member 39. When the upper portion 3*a* of the upper-die 3 is inserted between both the clamping members 5, 6 from below under the unclamped condition of the clamping apparatus, the upper portion 3*a* of the upper-die 3 can be located in place by means of a friction force of the urethane rubber gasket 37. As a result, it becomes possible to save time and labor associated with preparation work before the upper-die 3 is clamped to the ram 1.

Figure 5:
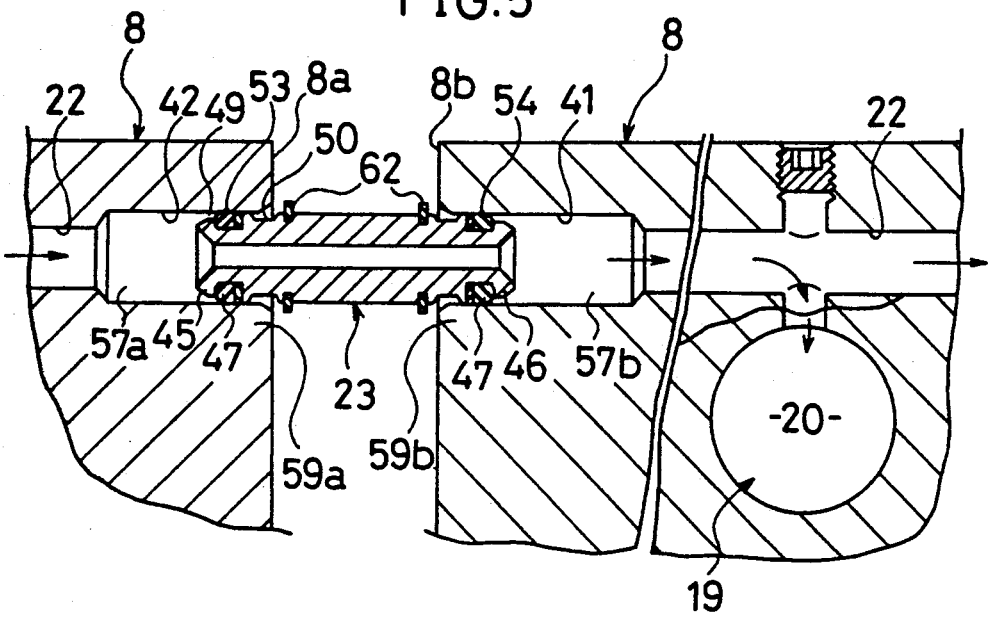

Next, the construction of the aforementioned interconnection pipe 23 will be explained in detail with reference to FIGS. 5 and 6. FIG. 5 is an enlarged vertical sectional view of the portion indicated by the arrow A in FIG. 1.

The aforementioned pressurized oil outlet port 42 is opened in the second lateral end surface 8*a* of the press plate 8 and the aforementioned pressurized oil inlet port 41 is opened in the first lateral side surface 8*b*. These pressurized oil outlet port 42 and pressurized oil inlet port 41 are coaxially opposed to each other. A first pipe end portion as an upstream side end portion 45 of the interconnection pipe 23 is oil-tightly fitted into the pressurized oil outlet port 42 through a sealing means 47 such as an O-ring. A second pipe end portion as a downstream side end portion 46 of the interconnection pipe 23 is oil-tightly fitted into the pressurized oil inlet port 41 through another sealing means 47. A swing allowing gap 49 and a swing allowing groove 50 are formed in the first pipe end portion 45 and in the second pipe end portion 46 on both the left and right opposed sides of the sealing means 47 respectively. Thereby, the respective end portions 45, 46 of the interconnection pipe 23 are allowed to swing with respect to the pressurized oil outlet port 42 and the pressurized oil inlet port 41 so as to absorb an alignment gap between the pressurized oil outlet port 42 and the pressurized oil inlet port 41 and to result in facilitating assembly.

Further, the fitting portion 53 between the pressurized oil outlet port 42 and the first pipe end portion 45 and the fitting portion 54 between the pressurized oil inlet port 41 and the second pipe end portion 46 are constructed as follows.

A pipe shiftable space 57*a* is provided in the deep portion of the pressurized oil outlet port 42 as well as another pipe shiftable space 57*b* is provided also in the deep portion of the pressurized oil inlet port 41. Fitting holding stoppers 62, 62 composed of stop rings are detachably externally fitted to the first pipe end portion 45 and to the second pipe end portion 46.

The aforementioned interconnection pipe 23 functions as follows under the used condition illustrated in FIG. 5. That is, the interconnection pipe 23 is prevented from leftward shifting by fitting the stopper 62 to the left first pipe end portion 45 and changing over the stopper 62 to the stop position, so that the right fitting portion 54 can be held in the fitted condition. Further, the interconnection pipe 23 is prevented from rightward shifting by fitting the other stopper 62 to the right second pipe end portion 46, so that also the left fitting portion 53 can be held in the fitted condition.

Figure 6:
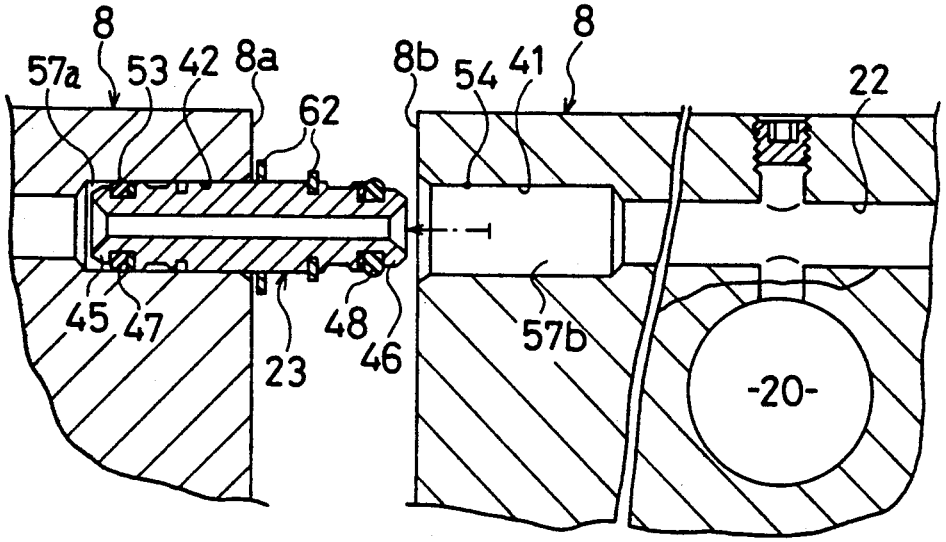

On the other hand, when the press plate 8 is removed from the ram 1 in order to carry out a maintenance operation and the like of the hydraulic cylinder 19, as illustrated in FIG. 6, the stopper 62 is removed from the left first pipe end portion 45 and then changed over to the stop cancellation position so as to allow the first pipe end portion 45 to be slid toward the left side. Thereby, the second pipe end portion 46 can be pulled out of the pressurized oil inlet port 41 as the right fitting portion 54 is released from the fitting engagement.

According to the above-mentioned embodiment, the following advantages can be provided.

Since the pressurized oil outlet port 42 and the pressurized oil inlet port 41 are coaxially opposed to each other, it becomes possible to manufacture a plurality of the press plates 8 as a common component part so as to reduce manufacturing costs of the whole clamping apparatus.

Since the hydraulic pipe employed in the conventional prior art embodiment corresponding to the interconnection pipe 23 of the present invention takes a reversed U-shaped standing posture, air stagnation tends to be provided therein and also the length of the hydraulic pipe is comparatively long. Further, since it is difficult to carry out air removal in the reversed U-shaped hydraulic pipe, a quantity of the air mixed into the pressurized oil increases. By that increased quantity of the mixed air, it becomes necessary to increase a delivery quantity of the pressurized oil from the hydraulic pump, and an operation time required for performing the clamping operation becomes longer. Especially, when the hydraulic pipe is composed of a hose which tends to expand in volume by the pressurized oil, those disadvantages become evident.

To the contrary, since the interconnection pipe 23 of the present invention is made straight, an air stagnation space can be made extremely small and also the length of the piping can be made short. Accordingly, the time required for removing the air can be shortened. Further, since the air removal can be facilitated as well as the quantity of the air mixed into the pressurized oil can be decreased, the operation time required for the clamping or unclamping operation becomes short.

Since a screw engagement connection can be omitted from the connecting portions between the interconnection pipe 23 and the pressurized oil outlet port 42 and between the interconnection pipe 23 and the pressurized oil inlet port 41, it becomes possible to prevent a leakage of the pressurized oil which might be caused by a slacking at the connecting portion caused by a shock at the time of starting of the press brake operation.

Further, since an uneven contact of the sealing means 47 can be prevented by the allowed swinging of the first pipe end portion 45 or the second pipe end portion 46, a pressurized oil leakage can be prevented.

In the case that any one of a plurality of the press plates 8 arranged side by side in the left and right direction is dismounted from the ram 1, the respective interconnection pipes 23 on the upstream side and on the downstream side thereof can be recessed into the respective pipe shiftable spaces 57*a*, 57*b* correspondingly. Thereupon, since the dismounting of any one of the press plates 8 is facilitated by such recessing, maintenance of the hydraulic cylinder 19 is ready.

FIGS. 7 through 11 and FIG. 12 illustrate other embodiments respectively. In the respective embodiments, as a general rule, component parts having the same functions as those in the above-mentioned first embodiment are designated by the same symbols.

FIGS. 7 through 11 illustrate a second embodiment.

Figure 7:
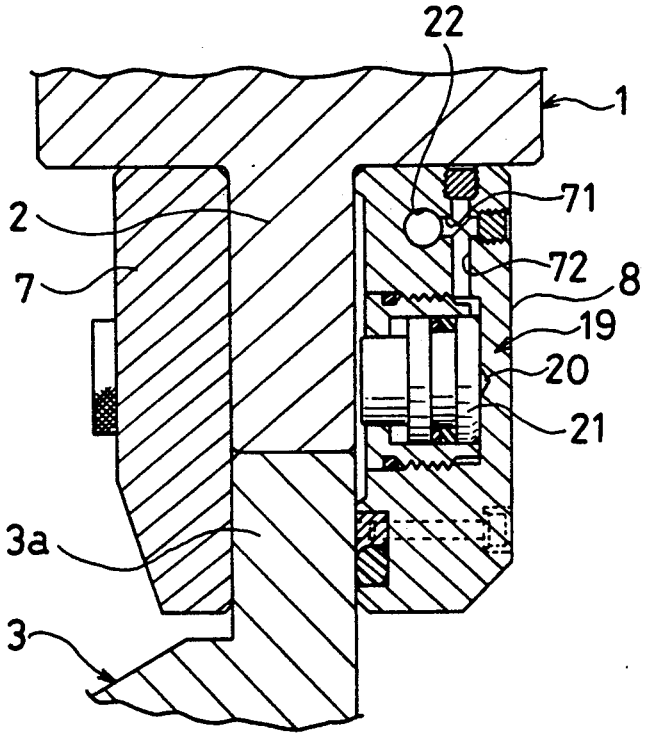
FIGS. 7 through 11 illustrate a second embodiment thereof.

As illustrated in FIG. 7, communication passage 22 is formed in the upper back portion (the upper left portion in the figure) of the press plate 8. The communication passage 22 is connected in communication to the operating oil chamber 20 of the hydraulic cylinder 19 through two through-holes 71, 72. The piston 21 of the hydraulic cylinder 19 is arranged above the upper end surface of the upper portion 3*a* of the upper-die 3.

Figure 8:
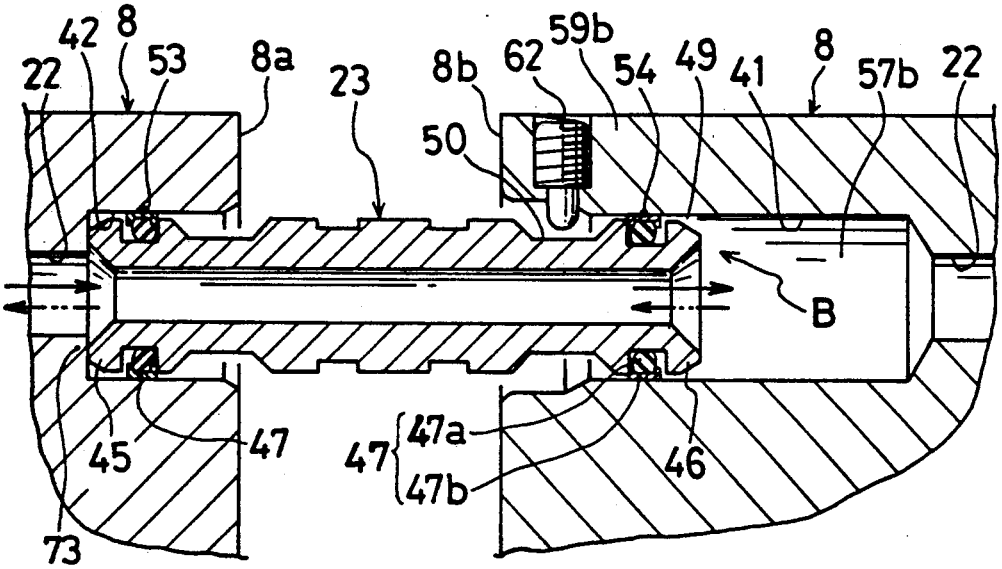

As illustrated in FIG. 8, the sealing means 47 for the interconnection pipe 23 is composed of an O-ring 47*a* and a cap type sealing member 47*b*. The pipe shiftable space 57*b* for the interconnection pipe 23 is provided only in the pressurized oil inlet port 41 on the right side. The fitting holding stopper 62 composed of a set screw is threadably engaged with the peripheral wall 59*b* of the pressurized oil inlet port 41 so that the lower end portion of the stopper 62 is put into the swing allowing groove 50 of the second pipe end portion 46. The stopper 62 is changed over to the stop position by its downward advancement as illustrated, and to the contrary it is changed over to the stop cancellation position by its upward retreat. Further, a stop wall 73 is formed in the deep portion of the pressurized oil outlet port 42. The stop wall 73 serves to block the movement of the interconnection pipe 23 toward the first pipe end portion 45 (toward the left upstream side).

Figure 9:
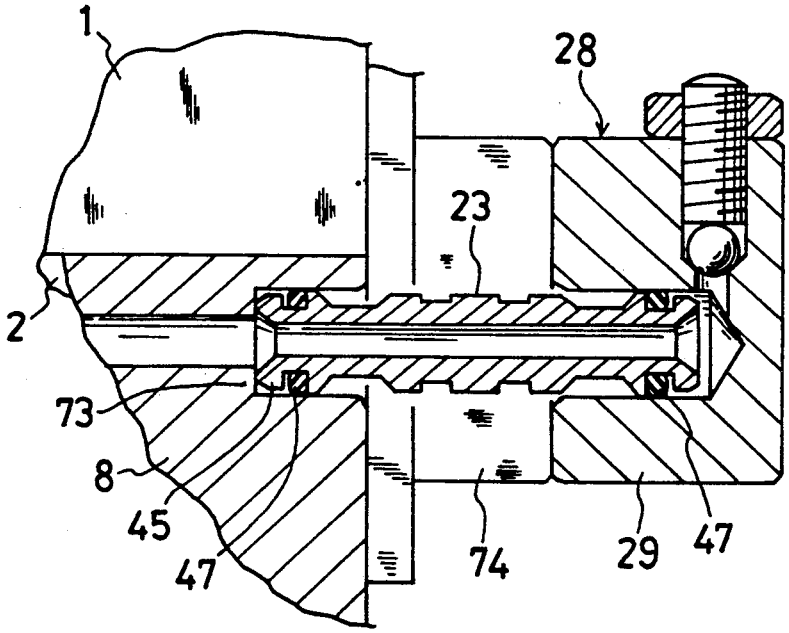

As illustrated in FIG. 9, the valve box 29 of the air removal valve 28 is fixedly secured to the lateral end surface of the ram 1 through a spacer 74. By selecting a suitable thickness for spacer 74, an interconnection pipe 23 having a standard length can be used also between the downstream-most press plate 8 and the valve box 29. Also the movement of the first pipe end portion 45 of the interconnection pipe 23 toward the left upstream side is blocked by the stop wall 73. The sealing means 47 for the interconnection pipe 23 is constructed in the same way as that illustrated in FIG. 8.

Figure 10:
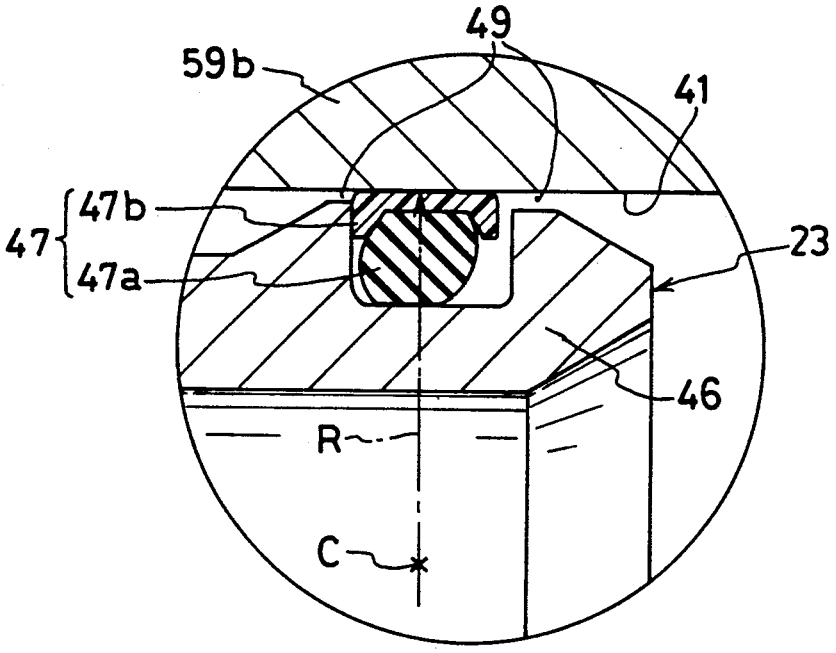

A construction of the sealing portion will be explained with reference to FIG. 10 which is an enlarged view of the portion indicated by the arrow B in FIG. 8. The sealing means 47 comprises a rubber O-ring 47*a* and a fluororesin cap type sealing member 47*b* externally fitted thereto. There are provided swing allowing gaps 49, 49 on the left and right sides of the sealing member 47*b*. Thereby, the second pipe end portion 46 is allowed to swing with the radius R about the center C on the axis of the second pipe end portion 46 so that an alignment gap between the pressurized oil outlet 42 (not illustrated in the figure) and the pressurized oil inlet port 41 can be absorbed. Even when a swing of the second pipe end portion 46 is caused, the external peripheral surface of the sealing member 47*b* is brought into strong contact with the internal peripheral surface of the pressurized oil inlet port 41 through the O-ring 47*a* by means of a hydraulic pressure within the pressurized oil inlet port 41 to surely prevent a pressurized oil leakage. Incidentally, also the first pipe end portion 45 (not illustrated in the figure) is constructed in the same way as that of the aforementioned second pipe end portion 46.

Figure 11:
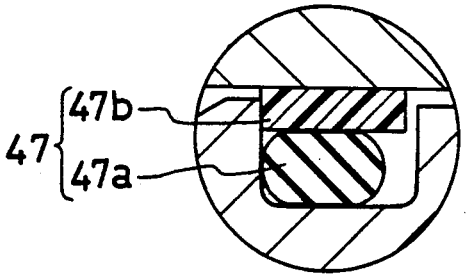

As illustrated in a variant of FIG. 11, the sealing means 47 may be composed of the O-ring 47*a* and the sealing member 47*b* may have a rectangular cross-section.

The construction of this second embodiment functions as follows with initial reference to FIG. 8.

At the time of unclamping operation of the clamping apparatus, as previously described, a pressurized oil is supplied to the operating oil chambers (not illustrated in the figure) of the respective press plates 8. In this case, as indicated by the arrow of the solid line in the figure, the pressurized oil flows from the pressurized oil outlet port 42 on the upstream side to the pressurized oil inlet port 41 on the downstream side. Thereupon, a pushing force caused by the stream of the pressurized oil acts on the interconnection pipe 23 even a little so as to move the interconnection pipe 23 toward the right side. But, since the pushing force is received and blocked by means of the stopper 62, the first pipe end portion 45 of the interconnection pipe 23 can be prevented from being pulled out of the pressurized oil outlet 42.

To the contrary, at the time of clamping operation thereof, when the pressurized oil is discharged from the operating oil chamber of each press plate 8, the pressurized oil flows toward the left side as indicated by the arrow of the alternate long and two short dashes line in the figure. In this case, a pressure within the upstream side operating oil chamber near a pressurized oil discharge outlet drops instantly, but there exists a time lag in the pressure dropping within the downstream side operating oil chamber due to an influence of the air mixed into the pressurized oil. Therefore, the pressure within the pressurized oil inlet port 41 becomes higher than that within the pressurized oil outlet port 42, so that a differential pressure therebetween tends to strongly push the interconnection pipe 23 toward the left side. But, the pushing force is received and blocked by the stop wall 73 of the press plate 8 without being hindered.

Figure 12:
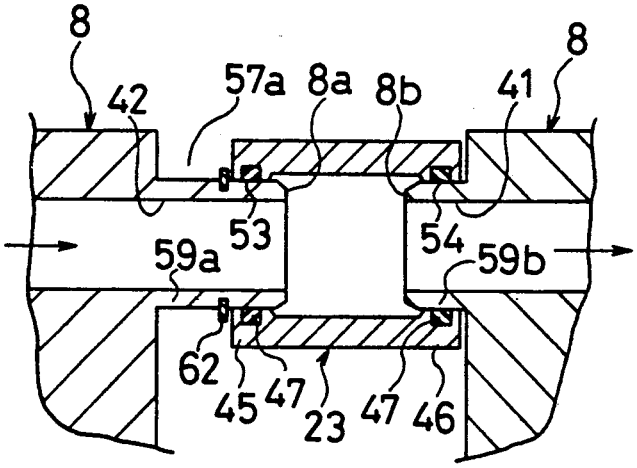
FIG. 12 illustrates a third embodiment thereof and is a view corresponding to FIG. 5.

FIG. 12 illustrates a third embodiment.

The interconnection pipe 23 is externally fitted at its opposed end portions to the peripheral walls 59, 59*b* of the pressurized oil outlet port 42 and of the pressurized oil inlet port 41. Both the fitting holding stopper 62 and the pipe shiftable space 57*a* are disposed in only the peripheral wall 59*a* of the press plate 8 on the upstream side (the left side).

Incidentally, the clamping apparatus of the present invention may be modified as follows.

The clamping receiving member 5 may be formed from one receiving plate instead of a plurality of the receiving plates 7. Further, although the clamping receiving plates 5 are fixedly secured to the ram 1 of the press brake by means of fixing bolts 11, it may be formed integrally with the ram 1.

Instead of the unclamping actuation means 13 comprising a hydraulic cylinder 19 as well as the clamping actuation means 14 employing a spring force, the clamping actuation means may be composed of the hydraulic cylinder and the unclamping actuation means may employ a spring force. Otherwise, both these actuation means 13, 14 may be composed of one set of double actuating hydraulic cylinder.

Although the present invention has been described by reference to particular illustrative examples it will be understood that variations and modifications are possible within the inventive concept.

What is claimed is:

1. A clamping apparatus for a press brake, adapted to fix an upper portion (3*a*) of an upper-die (3) to a lower portion (2) of a ram (1) extending in a horizontal direction, said clamping apparatus comprising:

a first clamping member (5) disposed on a first surface side of said ram lower portion (2);

a second clamping member (6) disposed on a second surface side of said ram lower portion (2), said second clamping member (6) being composed of a plurality of press plates (8) (8) arranged side by side in a horizontal direction;

each of said press plates (8) having a first lateral end surface (8*b*) and a second lateral end surface (8*a*); an unclamping actuation means (13) for moving said press plates (8) away from said first clamping member (5); and a clamping actuation means (14) for bringing the press plates (8) closer to said first clamping member (5), at least one of said unclamping and clamping actuation means (13) (14) comprising a hydraulic cylinder (19);

an operating oil chamber (20) of said hydraulic cylinder (19) being formed within said press plate (8);

a pressurized oil inlet port (41) opened in the first lateral end surface (8*b*) of said press plate (8) and connected to said operating oil chamber (20) for fluid communication therewith;

a pressurized oil outlet port (42) opened in the second lateral end surface (8*a*) of said press plate (8) and connected to said operating oil chamber (20) for fluid communication therewith with said pressurized oil inlet port (41) and said pressurized oil outlet port (42) of adjacent press plates (8) (8) facing each other;

an interconnection pipe (23) for connecting said pressurized oil outlet port (42) and said pressurized oil inlet port (41) of adjacent press plates (8) (8) for fluid communication therebetween.

2. A clamping apparatus as defined in claim 1, wherein said pressurized oil outlet port (42) and said pressurized oil inlet port (41) facing each other are coaxially arranged.

3. A clamping apparatus as defined in claim 2, wherein said interconnection pipe (23) is provided with a first pipe end portion (45) and a second pipe end portion (46), said first pipe end portion (45) being connected to said pressurized oil outlet port (42) and said second pipe end portion (46) being connected to said pressurized oil inlet port (41), each of these connections including sealing means (47) (47) for providing a fluid tight seal.

4. A clamping apparatus as defined in claim 3, wherein said first and second pipe end portions (45) (46) of said interconnection pipe (23) are swingably connected to said pressurized oil outlet port (42) and to said pressurized oil inlet port (41) respectively.

5. A clamping apparatus as defined in claim 4, further comprising:

a first fitting portion (53) between the pressurized oil outlet port (42) and the first pipe end portion (45);

a second fitting portion (54) between the pressurized oil inlet port (41) and the second pipe end portion (46);

at least one pipe shiftable space (57*a*) (57*b*) provided in at least one of said first and second fitting portions (53) (54); and a fitting holding stopper (62) provided in either said at least one pipe shiftable space (57*a*) (57*b*) or said first pipe end portion (45);

wherein when said clamping apparatus is in a pipe connected condition, said fitting holding stopper (62) is in a stop position and said second fitting portion (54) is held in a fitted state; and wherein when said clamping apparatus is in a pipe separated condition, said first pipe end portion (45) is located in said at least one pipe shiftable space (57*a*) (57*b*), said stopper (62) is changed to a stop cancellation position, and said second fitting portion (54) is taken out of said fitted state.

6. A clamping apparatus as defined in claim 5, wherein said at least one pipe shiftable space (57*b*) is provided between said pressurized oil inlet port (41) and said second pipe end portion (46); and there is provided, within said pressurized oil outlet port (42), a stop wall (73) which prevents movement of said interconnection pipe (23) toward said first pipe end portion (45).

* * * * *